US005261499A

United States Patent [19]

Grubb

[11] Patent Number: 5,261,499

[45] Date of Patent: Nov. 16, 1993

[54] TWO-PIECE ROTATABLE CUTTING BIT

[75] Inventor: Bruce R. Grubb, Snake Spring, Pa.

[73] Assignee: Kennametal Inc., Latrobe, Pa.

[21] Appl. No.: 915,156

[22] Filed: Jul. 15, 1992

[51] Int. Cl.[5] ..... E21C 35/18

[52] U.S. Cl. ..... 175/427; 299/92

[58] Field of Search ..... 175/354, 427; 299/86, 299/91, 92, 93, 79

[56] References Cited

U.S. PATENT DOCUMENTS

| | | | |
|---|---|---|---|
| 3,397,012 | 8/1968 | Krekler . | |
| 3,476,195 | 11/1969 | Galle . | |
| 3,519,309 | 7/1970 | Engle et al. . | |
| 3,720,273 | 3/1973 | McKenry et al. | 175/354 |
| 3,752,515 | 8/1973 | Oaks et al. . | |
| 3,830,321 | 8/1974 | McKenry et al. | 175/354 |
| 3,865,437 | 2/1975 | Crosby | 175/354 |
| 3,932,952 | 1/1976 | Helton et al. . | |
| 3,990,525 | 11/1976 | Penny . | |
| 4,084,856 | 4/1978 | Emmerich et al. | 175/354 |
| 4,201,421 | 5/1980 | Den Besten et al. . | |
| 4,346,934 | 8/1982 | College et al. | 175/354 |

FOREIGN PATENT DOCUMENTS

| | | |
|---|---|---|
| 867381 | 7/1949 | Fed. Rep. of Germany . |
| 2304495 | 9/1973 | Fed. Rep. of Germany . |
| 2327389 | 10/1977 | France . |
| 2590623 | 5/1987 | France . |
| 860768 | 2/1961 | United Kingdom . |

OTHER PUBLICATIONS

Kennametal Drawing QD-0224 (Dec. 15, 1976) for a 11.00 " Dredge Tooth.

Kennametal Drawing QD-0225 (Dec. 13, 1976) for a Shatt for a Dredge Tooth.

Kennametal Drawing SK-1227 (Jun. 30, 1976) for a Dredge Cutter with Thrust Bearing.

Kennametal Drawing Sk-1219 (Jun. 16, 1976) for a Dredge Cutter.

CMI Drawing-Assem-Bit & Holder (Jul. 13, 1984).

*Primary Examiner*—Ramon S. Britts
*Assistant Examiner*—Frank S. Tsay
*Attorney, Agent, or Firm*—John J. Prizzi

[57] ABSTRACT

A two-piece rotatable cutting bit which comprises a shank and a nose. The shank has an axially forwardly projecting protrusion which carries a resilient spring clip. The protrusion and spring clip are received within a recess in the nose to rotatable attach the nose to the shank.

10 Claims, 2 Drawing Sheets

TWO-PIECE ROTATABLE CUTTING BIT

BACKGROUND OF THE INVENTION

The invention pertains to a rotatable cutting bit which mounts to a stationary block on a rotatable drum wherein the bit impinges a substrate upon the rotation of the drum. More specifically, the invention pertains to the aforementioned type of bit which includes a replaceable head portion.

Rotatable cutting bits typically comprise a consumable portion of a complete cutting apparatus, such as, for example, a road planing machine or a coal mining machine. Broadly speaking, such a rotatable cutting bit comprises a unitary steel shank having a hard cutting insert at the forward end thereof and a retaining assembly at the rearward end thereof.

The shank mounts in the bore of a stationary block on a rotatable drum by means of a retainer assembly so that the cutting bit is rotatable relative to the block. U.S Pat. No. 4,201,421 to DenBesten et al. shows the use of a smooth sleeve to retain the mining bit within the bore of a block through frictional engagement between the sleeve retainer and the wall of the bore. U.S. Pat. No. 3,519,309 to Engle et al. shows the use of a dimple clip to rotatably connect a mining bit to a block. FIGS. 8 and 11 shows two embodiments where the radially outward projections of the dimple clip (FIG. 10) engage a channel or the like to retain the bit within the bore of the block. The same feature is present in FIG. 1 of U.S. Pat. No. 3,752,515 to Oaks et al.

In operation, the drum rotates so as to drive the cutting bit into the substrate whereby the hard cutting insert and the forward portion of the unitary steel shank experience the maximum amount of wear. Furthermore, the rotatable cutting bit rotates in the bore of the block so that both the rearward end of the shank and the wall of the bore experience wear.

Once the forward portion of the cutting bit wears to a point where it no longer is substantively effective, the operator of the cutting apparatus must replace the complete worn cutting bit with a complete new cutting bit. Typically, the operator removes the worn bits by using a pry bar to pry the bit out of the bore of the block or a pneumatic hammer to impact the bit out of the bore of the block. It is typically the case that the operator then discards the complete worn bit.

Eventually, the rotation of the cutting bit in the bore of the block causes the bore to wear to such an extent that the operator must replace the block. To replace the block, which is typically welded to the drum, the operator must remove the welded block from the drum and weld a new block to the drum. Such replacement of one or more blocks is a time-consuming activity which typically causes the operator to lose valuable operating time.

Thus, it would be highly desirable to provide a rotatable cutting bit that minimizes the costs involved with the replacement of worn cutting bits.

It would be highly desirable to provide a rotatable cutting bit that does not require the discarding of the complete cutting bit once the forward portion thereof has become worn.

It would be highly desirable to provide a rotatable cutting bit that minimizes the wear to the bore of the block caused by the rotation of the rotatable cutting bit.

SUMMARY OF THE INVENTION

It is an object of the invention to provide a rotatable cutting bit that minimizes the cost involved with the replacement of worn cutting bits.

It is another object of the invention to provide a rotatable cutting bit that does not require the discarding of the complete cutting bit once the forward portion thereof has become worn past a point of useful life.

Finally, it is another object of the invention to provide a rotatable cutting bit that minimizes the wear on the bore of the block caused by the rotation of the rotatable cutting bit.

In one form thereof, the invention is a rotatable cutting bit which comprises an elongate shank with opposite forward and rearward ends. A protrusion extends axially forward of the forward end of the shank. The rotatable cutting bit further includes a nose, which has a rearward surface containing a recess. A hard cutting insert affixes to the forward end of the nose. A compressible spring clip, which has radially outwardly projecting bumps, is carried on the protrusion. When the shank and nose are assembled, the bumps register with a channel in the recess of the nose and the spring clip frictionally engages the surface of the recess so that the head is detachably connected to the shank in such a fashion such that the nose is rotatable relative to the shank.

In another form thereof, the invention is a rotatable cutting bit which comprises an elongate shank with opposite forward and rearward ends. A protrusion extends axially forwardly of the forward end of the shank. The protrusion has a circumferential channel therein. The rotatable cutting bit further includes a nose which has a rearward surface containing a recess. A hard cutting insert affixes to the forward end of the nose. A compressible spring clip has radially inwardly projecting bumps which register within the annular channel in the protrusion. When the shank and nose are assembled, the spring clip frictionally engages the surface of the recess thereby detachably connecting the nose and the shank in such a fashion so that the nose is rotatable relative to the shank.

These and other aspects of the present invention will become more apparent upon review of the drawings, which are briefly described below in conjunction with the detailed description of specific embodiments of the invention.

BRIEF DESCRIPTION OF THE DRAWINGS

Applicants now provide a brief description of the drawings which form a part of this patent application.

DETAILED DESCRIPTION OF SPECIFIC EMBODIMENT

Figure 1:
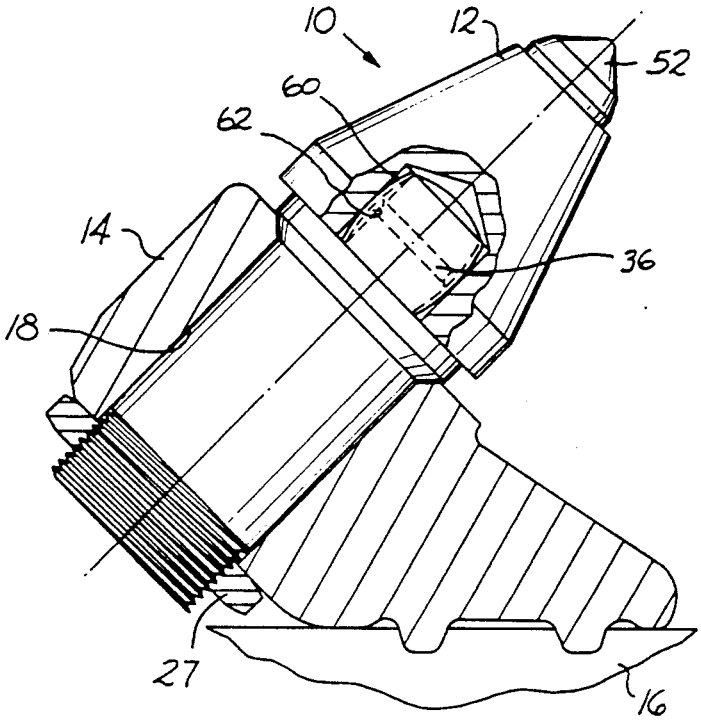
FIG. 1 is a side view of a first specific embodiment of the rotatable cutting bit of the invention wherein the block is shown in cross section to illustrate the relationship between the cutting bit and the block, and a portion of the nose of the bit is cut away so as to illustrate the connection between the shank and the nose of the cutting bit.
Figure 2:
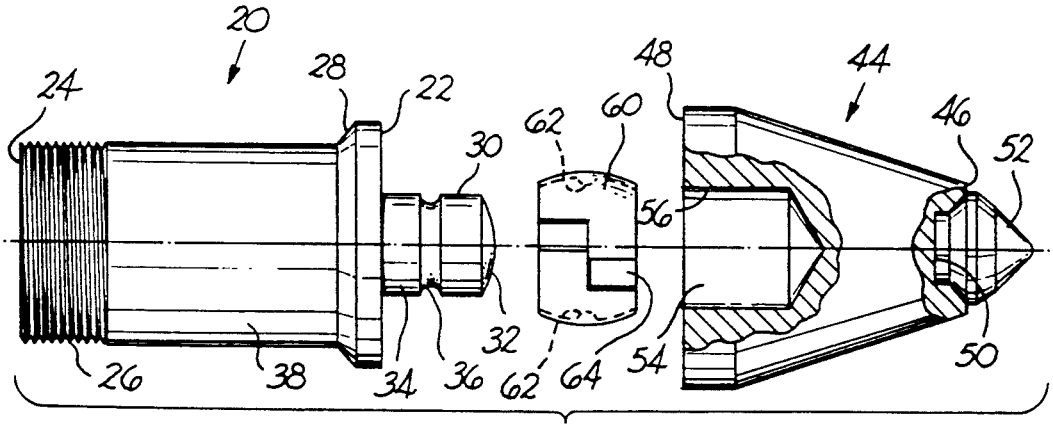
FIG. 2 is an exploded view of the components of the rotatable cutting bit of FIG. 1 wherein parts of the nose are shown in cut away so as to illustrate the rearward recess and forward socket in the nose of the cutting bit.

Referring to FIGS. 1 and 2, which illustrate the first specific embodiment of the invention, a bit-block assembly, generally designated 10, is shown by FIG. 1. Bit-block assembly 10 comprises the first specific embodiment of the rotatable cutting bit 12 and a block 14. The block 14 fixedly mounts, such as by welding, to a rotating member such as a wheel or drum 16. The block 14 further includes a smooth elongate bore 18.

The rotatable cutting bit 12 comprises a shank generally designated 20. Shank 20 has an axially forward end 22 and an opposite axially rearward end 24. The portion of shank 20 adjacent rearward end 24 presents threads 26. The portion of shank 20 adjacent forward end 22 provides a shoulder 28. Furthermore, a generally cylindrical protrusion 30 extends axially forwardly of and from the surface of the forward end 22 of shank 20. Protrusion 30 includes a forward surface 32, and an annular side surface 34. Side surface 34 contains an annular channel 36 therein. The portion of shank 20 which is between the threaded portion 26 and shoulder 28 is the contact surface 38, which is the portion the shank 20 which contacts the wall of bore 18 of block 14.

Rotatable cutting bit 12 further includes a nose generally designated as 44. Nose 44 has an axially forward end 46 and an opposite axially rearward end 48. Nose 44 contains a socket 50 adjacent the forward end 46 thereof. A hard carbide tip 52 fixedly mounts, such as by brazing, into socket 50. Nose 44 contains a recess 54 at the rearward end of 48 thereof. Recess 54 is of a generally cylindrical shape and is defined by an annular wall 56.

Rotatable cutting bit 12 further includes a split ring retainer 60 having radially inwardly projecting bumps 62. Retainer 60 is in the shape of a ring, but includes a slit 64 which permits the retainer 60 to resiliently compress in a radially inwardly direction under the influence of a radially inward force.

In regard to the assembly of the components of the rotatable cutting bit 12, the protrusion 30 carries the retainer 60 by virtue of the registration of bumps 62 within the volume of annular channel 36. When the shank 20 and the nose 44 are assembled, the recess 54 receives the retainer 60 carried by the protrusion 30. Because it is resiliently compressible, the retainer 60 frictionally engages the wall 56 of recess 54 so as to securely hold nose 44 to shank 20. Because retainer 60 is free to rotate relative to shank 20, the frictional engagement between retainer 60 and wall 56 provides for nose 44 to be able to rotate relative to shank 20.

Referring specifically back to FIG. 1, there is shown a specific embodiment where a nut 27 is threaded to shank 20 via threads 26 so as to securely hold the shank 20 to the block 14 in a non-rotatable manner.

In the operation of the first specific embodiment, the wheel or drum 16 rotates so as to drive the cutting bit 12 into a substrate to be cut. The carbide tip 52 is the part of the rotatable cutting bit 12 that first impinges the substrate. Pieces of the substrate abrade both the carbide tip 52 as well as the forward portion of the nose 44. Once the carbide tip 52, and possibly the forward portion of the nose 44, have worn to a point where the cutting bit 12 is essentially past its useful life, it is appropriate to substitute the worn rotatable cutting bit 12 with a new cutting bit.

In the first specific embodiment of the invention, the nut 27 would be unthreaded and removed from the threaded portion 26. The bit 12, if necessary, then would be knocked out of the bore 18 of the block 14 with a hammer, pneumatic tool or the like. The nose 44 would be detached from the shank 20 in any appropriate fashion. A new nose 44, and retainer 60 if necessary, would be assembled to the old shank 20. The complete rotatable cutting bit 12 then would be reinserted into the bore 18, and the nut 27 then threaded at the threaded portion 26 so as to firmly secure the entire bit 12 via the shank 20 to the block 14.

In the alternative, once the rotatable cutting bit 12 has worn past its useful life, rather than remove the entire bit assembly from the block to substitute a new cutting bit for the worn cutting bit, it is appropriate to remove only the nose 44 from the shank 20. Although not illustrated, the shank 20 would contain an annular puller groove. This puller groove would receive a tool, such as a pry bar, so as to facilitate the removal of the nose from the shank.

The shank 20 remains in the bore 18 of the block. The new nose 44, and retainer 60 if necessary, would then be assembled to the shank 20, which remains in the bore 18. As can be appreciated, this procedure eliminates the necessity of removing the shank 20 from the bore 18 to change the nose 44 of the bit assembly.

As can be seen, the first specific embodiment of the invention provides an improved rotatable cutting bit wherein after the cutting bit 12 has worn past its useful life, only a part of the bit must be discarded while the remainder of the bit can be reused. Furthermore, in the first specific embodiment, because the shank 20 does not rotate relative to the block 14, there is essentially no wear on the bore 18 of the block 14 thereby prolonging the useful life of the block 14.

It is very apparent that the conservation of a portion of the bit for multiple uses and the virtual elimination of wear on the block are meaningful advantages associated with the first specific embodiment of the invention.

Figure 3:
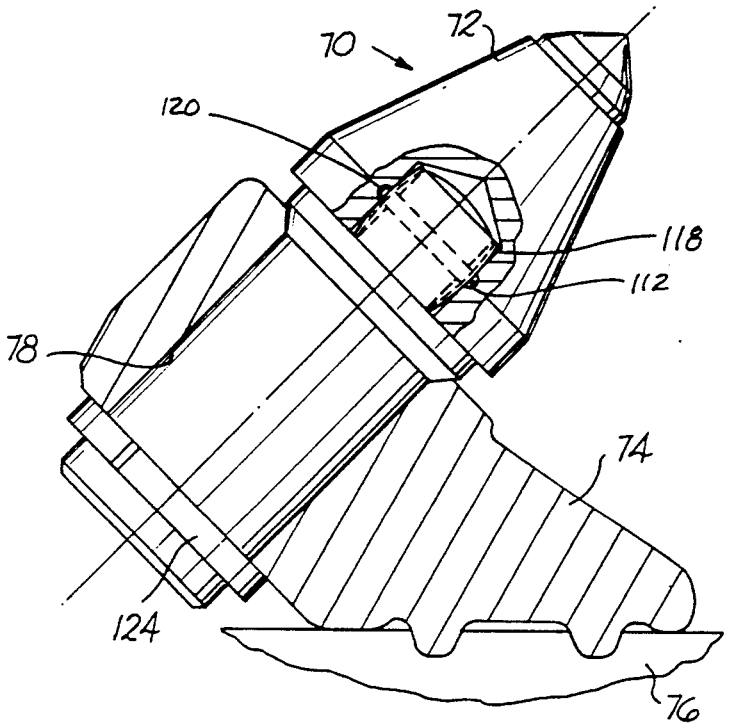
FIG. 3 is a side view of a second specific embodiment of the rotatable cutting bit of the invention wherein the block is shown in cross section to illustrate the relationship between the cutting bit and the block, and a portion of the nose of the cutting bit is cut away so as to illustrate the connection between the shank and the nose of the cutting bit.
Figure 4:
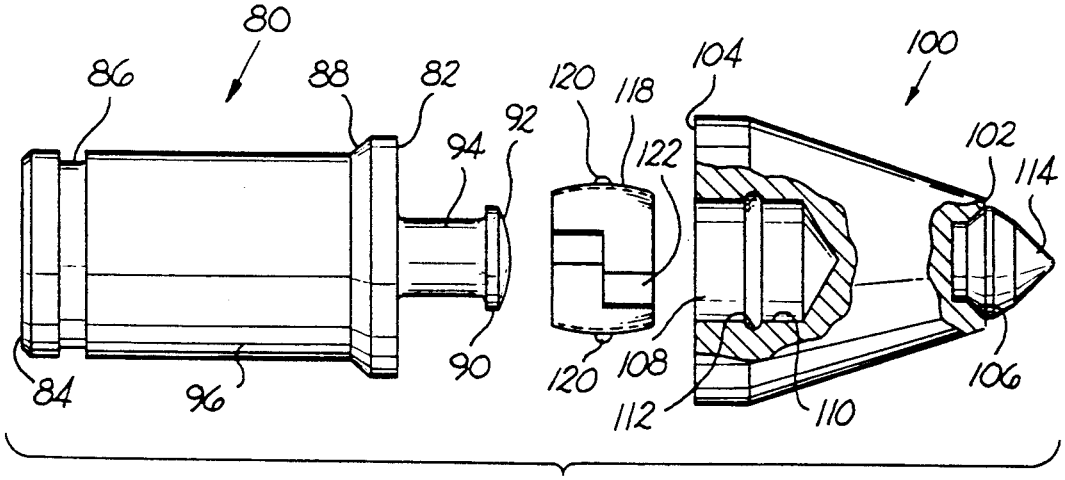
FIG. 4 is an exploded view of the components of the rotatable cutting bit of FIG. 3 wherein parts of the nose are cut away so as to illustrate the rearward recess and forward socket in the nose of the cutting bit.

Referring to FIGS. 3 and 4, these Figures illustrate a second specific embodiment of a bit-block assembly generally designated as 70. Bit-block assembly 70 includes a bit 72, and a block 74 which fixedly mounts, such as by welding, to a rotating member, such as a wheel or drum 76. Block 74 includes a smooth elongate bore 78.

The rotatable cutting bit 72 includes a shank 80 which has an axially forward end 82 and an opposite axially rearward end 84. Shank 80 contains an annular rear groove 86 adjacent the rearward end 84 thereof. Shank 80 further includes an enlarged diameter shoulder 88 adjacent the forward end 82 thereof. A protrusion 90 extends axially forwardly of and from the surface of the forward end 82 of shank 80. Protrusion 90 includes enlarged diameter portion 92 adjacent the axially forward termination point thereof. Protrusion 90 further includes a reduced diameter portion 94 defined between the forward end 82 of shank 80 and the enlarged diameter portion 92. Shank 80 further includes a cylindrical surface 96 defined between the rear groove 86 and the shoulder 88.

The rotatable cutting bit 72 also includes a nose generally designated as 100. Nose 100 includes an axially forward end 102 and an opposite axially rearward end 104. Nose 100 contains a socket 106 at the forward end 102 thereof. Nose 100 contains a recess 108 at the rearward end 104 thereof. Recess 108 is defined in part by a generally cylindrical wall 110, which includes an annular channel 112 contained therein.

A hard carbide tip 114 fixedly mounts, such as by brazing, in socket 106.

Rotatable cutting bit 72 also includes a split ring retainer 118 which is of a generally cylindrically shape containing radially outwardly projecting bumps 120. Retainer 118 is split via a channel 122 so that it is resiliently compressible in a radially inward direction.

Referring to the assembly of the component of the rotatable cutting bit 72, the retainer 118 is rotatably retained within the reduced diameter portion 94 of protrusion 90. When the shank 80 and nose 100 are assembled together, the recess 108 of nose 100 receives the protrusion 90 and the retainer 118 in such a fashion that the bumps 120 are received within channel 112. Furthermore, because it is resiliently compressible, retainer 118 frictionally engages wall 110 of recess 108. The combination of the frictional engagement along with the reception of the bumps 120 within channel 112 securely retains the nose 100 to the shank 80. Because the retainer 118 is free to rotate relative to shank 80, nose 100 is also free to rotate relative to shank 80.

Referring specifically to FIG. 3, the cylindrical surface 96 of shank 80 is positioned within the volume of bore 78. A snap ring 124 is received within rear groove 86 to thereby maintain the rotatable cutting bit 72 within the block 74 in such a fashion so that the rotatable cutting bit 72 is free to rotate to some extent relative to the block 74.

In operation, the drum 76 rotates so as to drive rotatable cutting bit 72 in to the substrate. The hard carbide tip 114 is the first part of cutting bit 72 to impinge upon the substrate. The hard carbide tip, as well as the axially forward portion of the nose 100, wear over time to a point where the cutting bit becomes essentially unsuitable for further use. At this point in time, it is necessary to replace the worn nose of the bit with a new nose.

The snap ring 124 is removed from the rear grove 86 and the rotatable cutting bit 72 is removed from the bore 78 of block 74 via a hammer, pneumatic tool or the like. The nose 100 is then detached from the shank 80 in a suitable fashion. A new nose 100, and retainer 118 if necessary, is assembled to the old shank 80. The complete rotatable cutting bit is then reinserted into the bore 78, and secured to the block 74 via the snap ring 124.

In the alternative, once the rotatable cutting bit 72 has worn past its useful life, rather than remove the entire bit assembly from the block to substitute a new cutting bit for the worn cutting bit, it is appropriate to remove only the nose 100 from the shank 80. Although not illustrated, the shank 80 would contain an annular puller groove. This puller groove would receive at tool, such as a pry bar, so as to facilitate the removal of the nose from the shank.

The shank 80 remains in the bore 18 of the block. The new nose 100, and retainer 118 if necessary, would then be assembled to the shank 80, which remains in the bore 78. As can be appreciated, this procedure eliminates the necessity of removing the shank 80 from the bore 78 to change the nose 100 of the bit assembly.

As can be appreciated, the second specific embodiment of the invention provides the same advantages as those provided by the first specific embodiment of the invention, except with respect to the wear caused by the rotation of the shank of the rotatable cutting bit in the bore of the block.

The material for the hard carbide tip is typically a cemented tungsten carbide which is an alloy of tungsten carbide and cobalt. The cemented carbide tip may be composed of any one of the standard tungsten carbide-cobalt compositions conventionally used for construction applications. The specific grade of cemented carbide depends upon the particular application to which one puts the tool. The cobalt content ranges from about 5 to about 13 weight percent with the balance being tungsten carbide, except for impurities. For rotatable cutting tools used in road planing, it may be desirable to use a standard tungsten carbide grade containing between about 5.4 to about 6.0 weight percent cobalt (balance WC) and having a Rockwell A hardness between about 88.2 and about 88.8.

In regard to all of the specific embodiments, it is preferred that a high temperature braze material be used in joining the cemented carbide insert to the steel body so that braze joint strength is maintained over a wide temperature range. The preferred braze material is a HIGH TEMP 080 manufactured and sold by Handy & Harman, Inc., 859 Third Avenue, New York, N.Y. 10022. The nominal composition (weight percent) and the physical properties of the Handy & Harman HIGH TEMP 080 braze alloy are set forth in the pertinent product literature from Handy & Harman. Furthermore, this product literature states that U.S. Pat. No. 4,631,171 covers the HIGH TEMP 080 braze alloy.

Other specific embodiments of the invention will be apparent to those skilled in the art from a consideration of this specification or practice of the invention disclosed herein. It is intended that the specification and specific embodiments be considered as exemplary only, with the true scope and spirit of the invention being indicated by the following claims.

What is claimed is:

1. A rotatable cutting bit comprising:

an elongate shank having opposite forward and rearward ends, a protrusion extending axially forward of the forward end of the shank;

a nose having a rearward surface containing a general cylindrical recess therein, an annular channel being disposed within a wall defining said recess, a hard cutting insert being affixed to the forward end of the nose;

a compressible spring clip having radially outwardly projecting bumps, and said spring clip being circumferentially mounted around the protrusion; and when the shank and nose are assembled said bumps being registered with the channel in the recess of the nose and the spring clip being frictionally engaged the surface of the recess so that the nose is detachably connected to the shank in such a fashion that the nose is rotatable relative to the shank.

2. The rotatable cutting bit of claim 1 wherein said shank has threads adjacent the rearward end thereof.

3. The rotatable cutting bit of claim 1 wherein said shank has an annular groove adjacent the rearward end thereof.

4. The rotatable cutting bit of claim 1 wherein said protrusion is of a cylindrical shape.

5. The rotatable cutting bit of claim 4 wherein the protrusion contains a reduced diameter portion, and the spring clip being rotatably retained within the reduced diameter portion of the protrusion.

6. The rotatable cutting bit of claim 1 wherein a hard carbide tip is affixed to the forward end of the nose.

7. A rotatable cutting bit comprising:

an elongate shank having opposite forward and rearward ends, a protrusion extending axially forward of the forward end of the shank, said protrusion having a circumferential channel therein;

a nose having a rearward surface containing a generally cylindrical recess therein, a hard cutting insert being affixed to the forward end of the nose;

a compressible spring clip having radially inwardly projecting bumps, the bumps registering within the annular channel when circumferentially mounted around the protrusion; and when the shank and nose are assembled, the spring clip being frictionally engaged the surface of the recess thereby detachably connecting the nose and the shank in such a fashion so that the nose is rotatable relative to the shank.

8. The rotatable cutting bit of claim 7 wherein a hard carbide tip is affixed to the forward end of the nose.

9. The rotatable cutting bit of claim 7 wherein said shank has threads adjacent the rearward end thereof.

10. The rotatable cutting bit of claim 7 wherein said shank has an annular groove adjacent the rearward end thereof.

* * * * *